US009132640B2

(12) United States Patent
Wilson et al.

(10) Patent No.: US 9,132,640 B2
(45) Date of Patent: Sep. 15, 2015

(54) CAP ASSEMBLY FOR PRINT HEAD DEVICE

(75) Inventors: Rhonda Lynn Wilson, Monmouth, OR (US); Holli Ogle, Portland, OR (US); Silam J Choy, Corvallis, OR (US)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

(21) Appl. No.: 14/414,654

(22) PCT Filed: Sep. 12, 2012

(86) PCT No.: PCT/US2012/054841
§ 371 (c)(1),
(2), (4) Date: Jan. 13, 2015

(87) PCT Pub. No.: WO2014/042627
PCT Pub. Date: Mar. 20, 2014

(65) Prior Publication Data

US 2015/0202874 A1 Jul. 23, 2015

(51) Int. Cl.
*B41J 2/165* (2006.01)

(52) U.S. Cl.
CPC ..... *B41J 2/16505* (2013.01); *B41J 2/16508* (2013.01); *B41J 2/16511* (2013.01); *B41J 2/16547* (2013.01); *B41J 2/16585* (2013.01)

(58) Field of Classification Search
CPC ..... B41J 2/16508; B41J 2/16511; B41J 2/16547; B41J 2/16585
See application file for complete search history.

(56) References Cited

U.S. PATENT DOCUMENTS 5,448,270 A 9/1995 Osborne
5,867,184 A 2/1999 Quintana
(Continued)

FOREIGN PATENT DOCUMENTS

JO 2003-034037 A 2/2003
JP 2007-216464 A 8/2007
(Continued)

OTHER PUBLICATIONS

International Searching Authority International Search Report. Date of mailing Feb. 28, 2013. Application No. PCT/US2012/054841 Filing date Sep. 12, 2012.

*Primary Examiner* — Lisa M Solomon
(74) *Attorney, Agent, or Firm* — Hewlett-Packard Patent Department

(57) ABSTRACT

A cap assembly is usable with a print head device having nozzles to eject fluid there through. The cap assembly includes an outer cap member, a sealing member, an intermediate cap member, and at least one resilient member. The outer cap member includes a main portion, at least one hinge portion to engage with the print head device to allow movement of the outer cap member toward the print head device to place the nozzles in a cap state, at least one latch portion to engage the print head device in the cap state, and at least one pedestal support portion extending outward from the main portion. The sealing member may seal the nozzles of the print head device in the cap state. The intermediate cap member may be disposed between the sealing member and the outer cap member. The intermediate cap member may support the sealing member. The at least one resilient member may be disposed between the sealing member and the intermediate cap member to provide a sealing force on the sealing member to seal the nozzles of the print head device in the cap state. Additionally, the at least one pedestal support portion may be configured to contact an external surface to support the print head device in the cap state.

15 Claims, 9 Drawing Sheets

(56) References Cited

U.S. PATENT DOCUMENTS

| | | | | |
|---|---|---|---|---|
| 5,956,053 | A | 9/1999 | Michael | |
| 6,045,216 | A | 4/2000 | Sasaki | |
| 6,280,015 | B1 | 8/2001 | Nguyen et al. | |
| 7,237,868 | B2 | 7/2007 | Lim | |
| 7,311,375 | B2 | 12/2007 | Suzuki | |
| 2005/0196198 | A1* | 9/2005 | Kawamura et al. | 399/262 |
| 2006/0012651 | A1 | 1/2006 | Lee et al. | |

FOREIGN PATENT DOCUMENTS

| | | | |
|---|---|---|---|
| JP | 2009-269236 | A | 11/2009 |
| WO | WO-2011136788 | A1 | 11/2011 |
| WO | WO-2012057741 | A1 | 5/2012 |

* cited by examiner

CAP ASSEMBLY FOR PRINT HEAD DEVICE

BACKGROUND

Print head devices such as inkjet print heads eject fluid such as ink through nozzles thereof to form images on a substrate. At times, when the print head device is not in use, the nozzles may be susceptible to becoming clogged are/or the fluid therein to evaporation. Thus, a cap assembly may be placed on the print head device when not in use such as during shipping, fabrication, and the like.

BRIEF DESCRIPTION OF THE DRAWINGS

Non-limiting examples are described in the following description, read with reference to the figures attached hereto and do not limit the scope of the claims. Dimensions of components and features illustrated in the figures are chosen primarily for convenience and clarity of presentation and are not necessarily to scale. Referring to the attached figures:

DETAILED DESCRIPTION

Print head devices such as inkjet print heads and/or inkjet print bars eject fluid such as ink through nozzles to form images on a substrate. The inkjet print heads, for example, may be in a form of an elongated print bar. At times, when the print head device is not in use, the nozzles may be susceptible to clogging are/or the fluid therein to evaporation. Thus, a cap assembly may be placed on the print head device when it is not in use such as during shipping, fabrication, and the like. However, when the print head device is in the cap state, external forces applied to the cap assembly may be directly transmitted to the sealing member resulting in translations thereof. Consequently, the sealing member may adversely pump air into and/or suck ink out of the print head device.

In examples, a cap assembly is usable with a print head device having nozzles to eject fluid there through. The cap assembly includes, among other things, an outer cap member, a sealing member, an intermediate cap member, and at least one resilient member. The outer cap member includes a main portion, at least one hinge portion to engage with the print head device to allow movement of the outer cap member toward the print head device to place the nozzles in a cap state, at least one latch portion to engage the print head device in the cap state, and at least one pedestal support portion extending outward from the main portion. The intermediate cap member may support the sealing member. The at least one resilient member may be disposed between the sealing member and the intermediate cap member to provide a sealing force on the sealing member to seal the nozzles of the print head device in the cap state. That is, the sealing member may isolate the nozzles from ambient air and reduce evaporative loss by creating a sealed volume which becomes humidified. Additionally, the at least one pedestal support portion may be configured to contact an external surface to support the print head device thereon, for example, in a vertical and stable position in the cap state. Further, when the print head device is in the cap state and supported by the cap assembly, a force and/or vibration imparted on the print head device may be transmitted to the outer cap member, rather than a direct force being applied to the sealing member. Thus, translations of the sealing member resulting in adversely pumping air into and/or sucking ink out of the print head device may be reduced.

Figure 1:
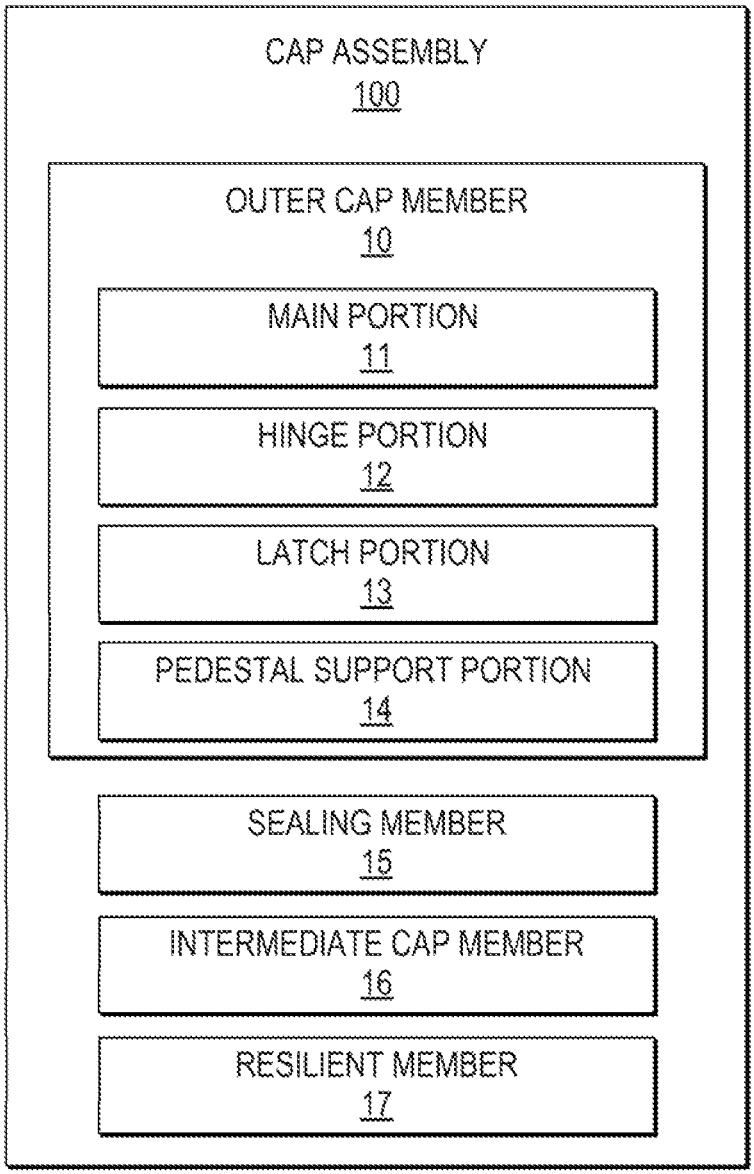
FIG. 1 is a block diagram illustrating a cap assembly according to an example.

FIG. 1 is a block diagram illustrating a cap assembly according to an example. A cap assembly may be usable with a print head device having nozzles to eject fluid there through. Referring to FIG. 1, in some examples, a cap assembly 100 includes an outer cap member 10, a sealing member 15, an intermediate cap member 16, and at least one resilient member 17. The outer cap member 10 includes a main portion 11, at least one hinge portion 12 to engage with the print head device to allow movement of the outer cap member 10 toward the print head device to place the nozzles in a cap state, at least one latch portion 13 to engage the print head device in the cap state, and at least one pedestal support portion 14 extending outward from the main portion 11.

Referring to FIG. 1, in some examples, the sealing member 15 may seal the nozzles of the print head device in the cap state. The intermediate cap member 16 may be disposed between the sealing member 15 and the outer cap member 10. The intermediate cap member 16 may support the sealing member 15. The at least one resilient member 17 may be disposed between the sealing member 15 and the intermediate cap member 16 to provide a sealing force on the sealing member 15 to seal the nozzles of the print head device in the cap state. Additionally, the at least one pedestal support portion 14 may be configured to contact an external surface to support the print head device, for example, in a vertical and stable position in the cap state. Further, when the print head device is in the cap state and supported by the cap assembly 100, a force and/or vibration imparted on the print head device may be transmitted to the outer cap member 10 rather than a direct force being applied to the sealing member 15. Thus, translations of the sealing member 15 resulting in adversely pumping air into and/or sucking ink out of the print head device may be reduced.

Figure 2:
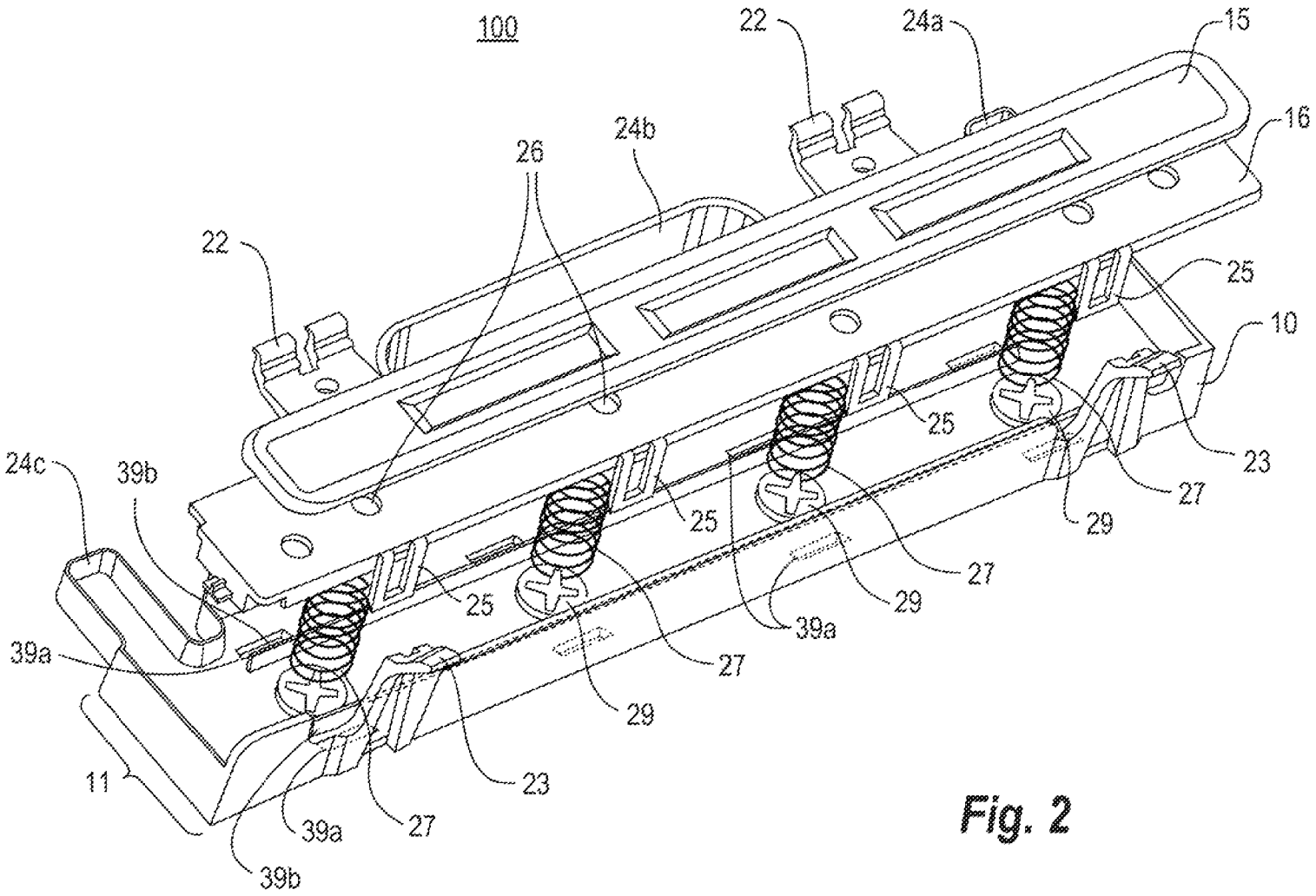
FIG. 2 is a perspective view illustrating a cap assembly in an unassembled state according to an example.
Figure 3:
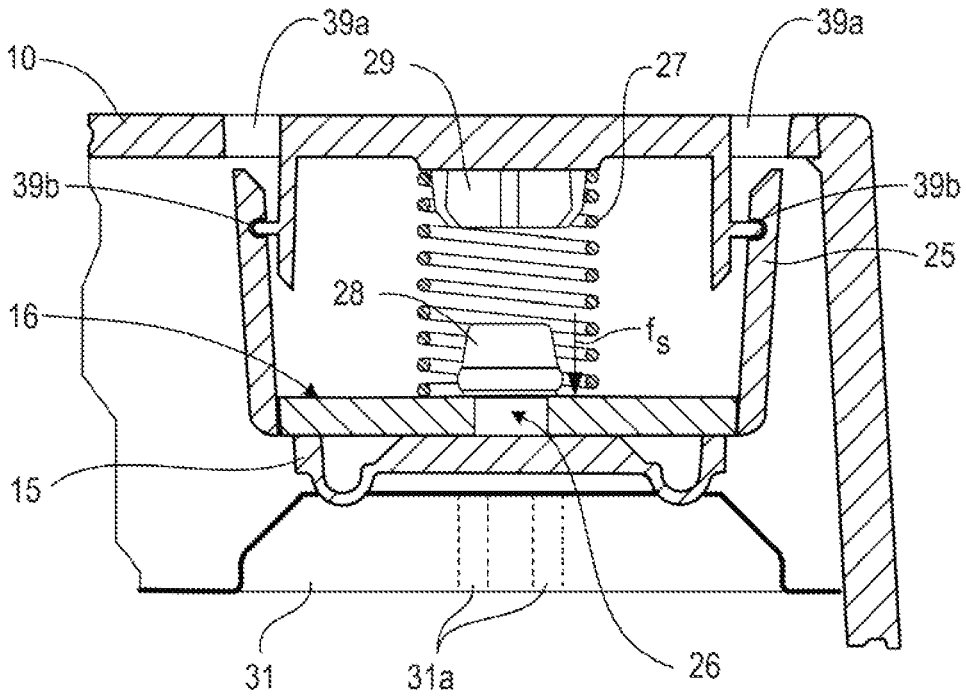
FIG. 3 is a cross-sectional view illustrating the cap assembly of FIG. 2 in a cap state according to an example.

FIG. 2 is a perspective view illustrating a cap assembly in an unassembled state according to an example. FIG. 3 is a cross-sectional view illustrating the cap assembly of FIG. 2 in a cap state according to an example. Referring to FIGS. 2-3, in some examples, the cap assembly 100 includes an outer cap member 10, a sealing member 15, an intermediate cap member 16, and a plurality of resilient members 27. The outer cap member 10 may include a main portion 11, a plurality of hinge portions 22, a plurality of latch portions 23, a plurality of main receiving portions 39*b*, a plurality of access ports 39*a*, and a plurality of pedestal support portions 24*a*, 24*b*, and 24*c* (collectively 24). The intermediate cap member 16 may include a plurality of intermediate engagement portions 25 to engage the main portion 11 of the outer cap member 10 such as the main receiving portions 39*b* thereof. For example, the intermediate engagement portions 25 may be elongated projections and the main receiving portions 39*b* may include detents to engage the intermediate engagement portions 25. The access ports 39*a* may be disposed in alignment with the main receiving portions 39*b* to allow a user access to disengage the engagement between the respective main receiving portions 39*b* and intermediate engagement portions 25, respectively, when desired.

The intermediate cap member 16 may also include a plurality of intermediate receiving portions 26 to receive sealing engagement portions 28 of the sealing member 15. The intermediate receiving portions 26 may be holes. In some examples, the intermediate cap member 16 may be lightweight, for example, to reduce dynamic motion of the cap assembly 100 during shipping shock and vibration. Additionally, the intermediate cap member 16 may be rigid, for example, to provide a foundation for the sealing member 15. That is, in some examples, the intermediate cap member 16 and/or the outer cap member 10 may be a single, unitary member.

Referring to FIGS. 2-3, in some examples, the sealing member 15 may include a plurality of sealing engagement portions 28 to engage the intermediate cap member 16. For example, the sealing engagement portions 28 may include elongated protrusions with each one having a varying width to be inserted into the intermediate receiving portions 26 of the intermediate cap member 16. The sealing member 15 may be replaced in the cap assembly 100, when necessary. In some examples, the sealing member 15 may be rubber such as ethylene propylene diene monomer (EPDM) and have a rubber hardness of substantially sixty durometer Shore A. In the assembled state, the sealing engagement portions 28 may extend beyond a surface of the intermediate cap member 16 and be configured to receive resilient members 27, respectively.

Referring to FIGS. 2-3, in some examples, the resilient members 27 may be disposed between the sealing member 15 and the intermediate cap member 16 to provide a sealing force $f_s$ on the sealing member 15 to seal the nozzles of the print head device 31 in the cap state. The interaction between the resilient members 27 and sealing member 15 may enable the sealing of nozzles by the sealing member 15 being applied with evenly distributed forces and conforming to a respective surface of a print head device 31 including the nozzles 31*a*. Accordingly, the sealing member 15 may, in cooperation with the resilient members 27, conform to a surface including the nozzles 31*a* to seal the nozzles 31*a*, even if it is an uneven surface. Additionally, the resilient members 27 may provide a predictable force and deflection of the sealing member 15. In some examples, the resilient members 27 may include springs. For example, the cap assembly 100 may include four springs.

Figure 4:
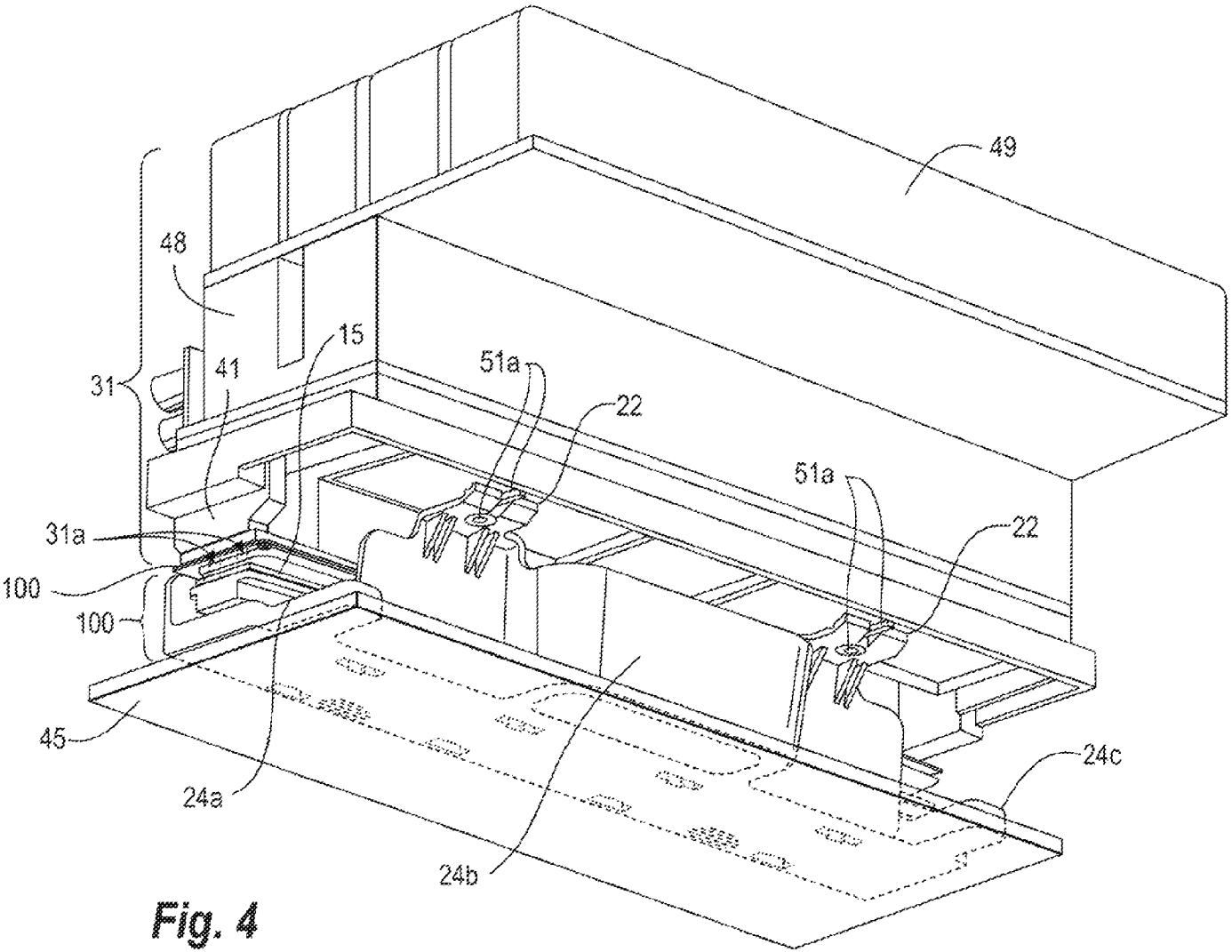
FIG. 4 is a perspective view illustrating the cap assembly of FIG. 2 in a cap state with a print head device according to an example.
Figure 5A:
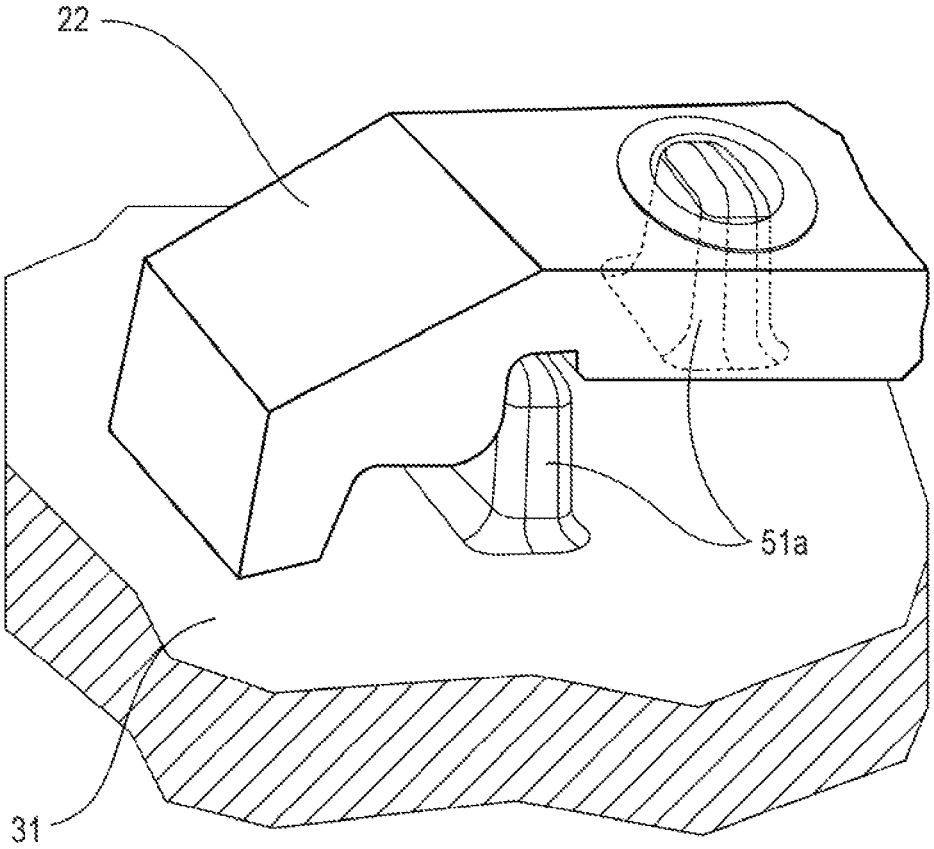
FIG. 5A is a perspective view illustrating a hinge portion of the cap assembly of FIG. 2 engaging a print head device according to an example.
Figure 5B:
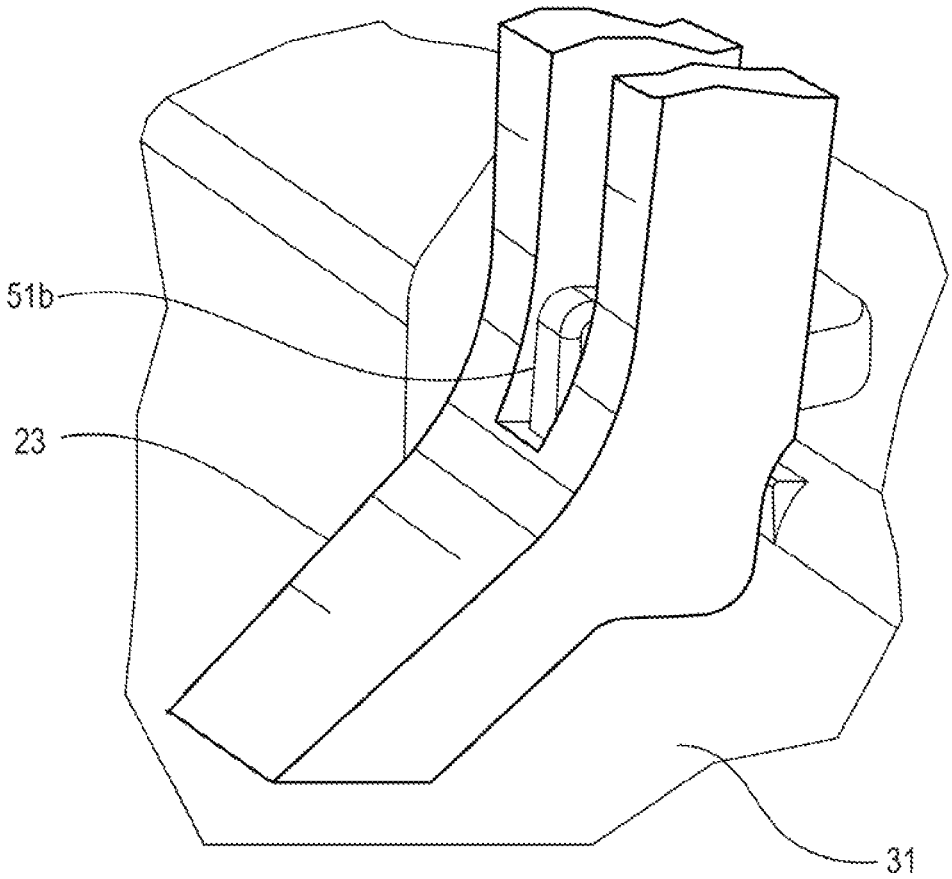
FIG. 5B is a perspective view illustrating a latch portion of the cap assembly of FIG. 2 engaging a print head device according to an example.

FIG. 4 is a perspective view illustrating the cap assembly of FIG. 2 in a cap state with a print head device according to an example. FIG. 5A is a perspective view illustrating a hinge portion of the cap assembly of FIG. 2 engaging a print head device in a cap state according to an example. FIG. 5B is a perspective view illustrating a latch portion of the cap assembly of FIG. 2 engaging a print head device in a cap state according to an example. Referring to FIGS. 4-5B, in some examples, the cap assembly 100 is in a cap state with a print head device 31. In some examples, the print head device 31 may include a print head module 41, a fluid supply module 49, and a supply station module 48 to transport fluid from the fluid supply module 49 to the print head module 41. In some examples, the fluid supply module 49 may include a plurality of removable fluid cartridges.

Referring to FIGS. 4-5B, in some examples, in the cap state, the cap assembly 100 engages the print head device 31 and covers nozzles 31*a* thereof. That is, the hinge portions 22 may engage a first set of projections 51*a* on the print head device 31 to move the cap assembly 100 toward a surface of the print head device 31 including the nozzles 31*a*. The latch portions 23 may engage a second set of projections 51*b* on the print head device 31 in the cap state. The intermediate cap member 16 may be disposed between the sealing member 15 and the outer cap member 10. The intermediate cap member 16 may support the sealing member 15.

Referring to FIGS. 4-5B, in some examples, the sealing member 15 may contact the surface including the nozzles 31*a*, for example, to seal the nozzles 31*a*. That is, the sealing member 15 may isolate the nozzles 31*a* from ambient air. Additionally, the resilient members 27 may be disposed between the sealing member 15 and the intermediate cap member 16 to provide a sealing force on the sealing member 15 to seal the nozzles 31*a* of the print head device 31 in the cap state. Additionally, the plurality of pedestal support portions 24*a*, 24*b*, and 24*c* may be configured to contact an external surface 45 to support the print head device 31 in the cap state. Further, a force and/or vibration imparted on the print head device 31 may be transmitted to the outer cap member 10, rather a direct force being applied to the sealing member 15. Thus, translations of the sealing member 15 resulting in adversely pumping air into and/or sucking ink out of the print head device 31 may be reduced.

Figure 6A:
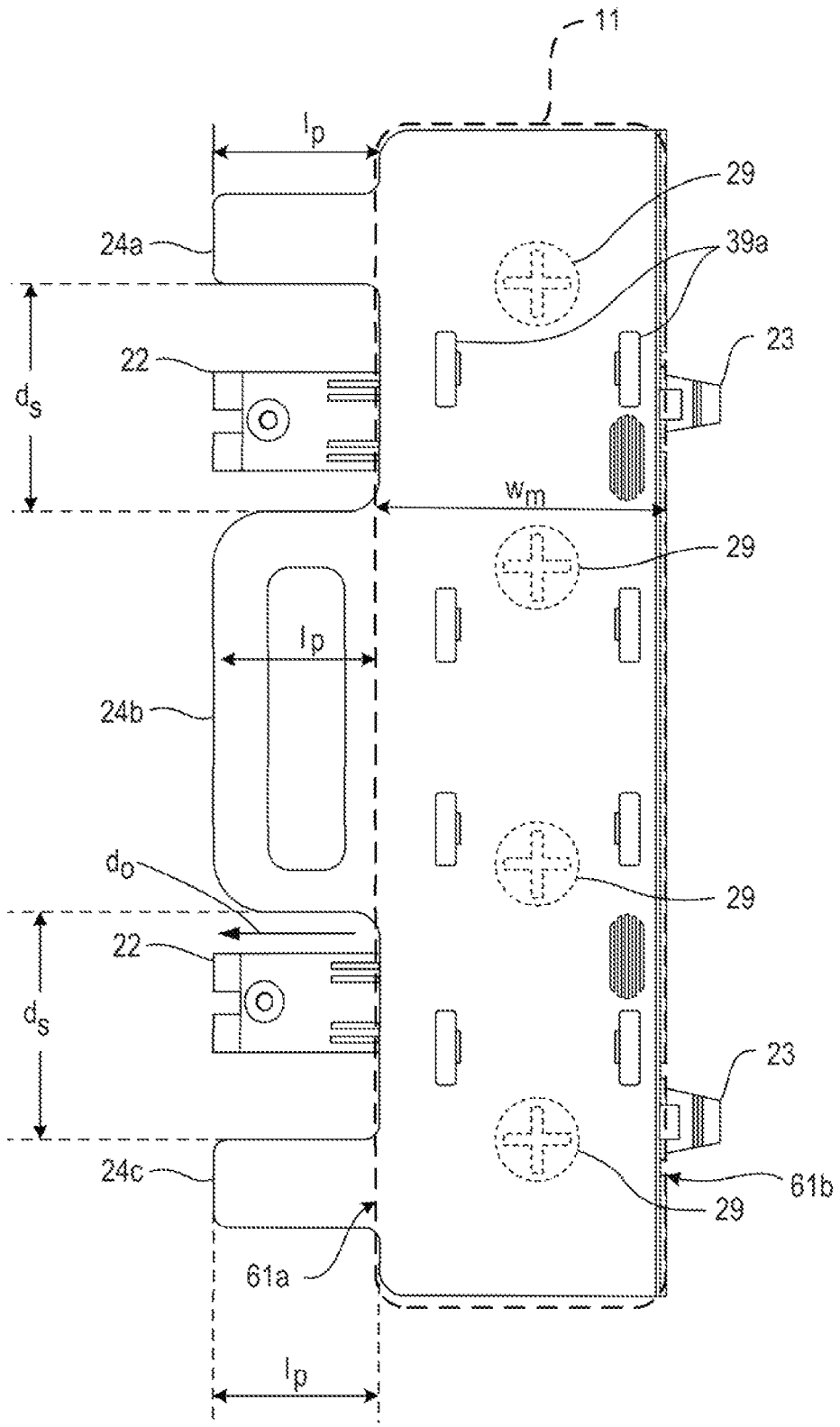
FIG. 6A is a bottom view illustrating an outer cap member of the cap assembly of FIG. 2 according to an example.
Figure 6B:
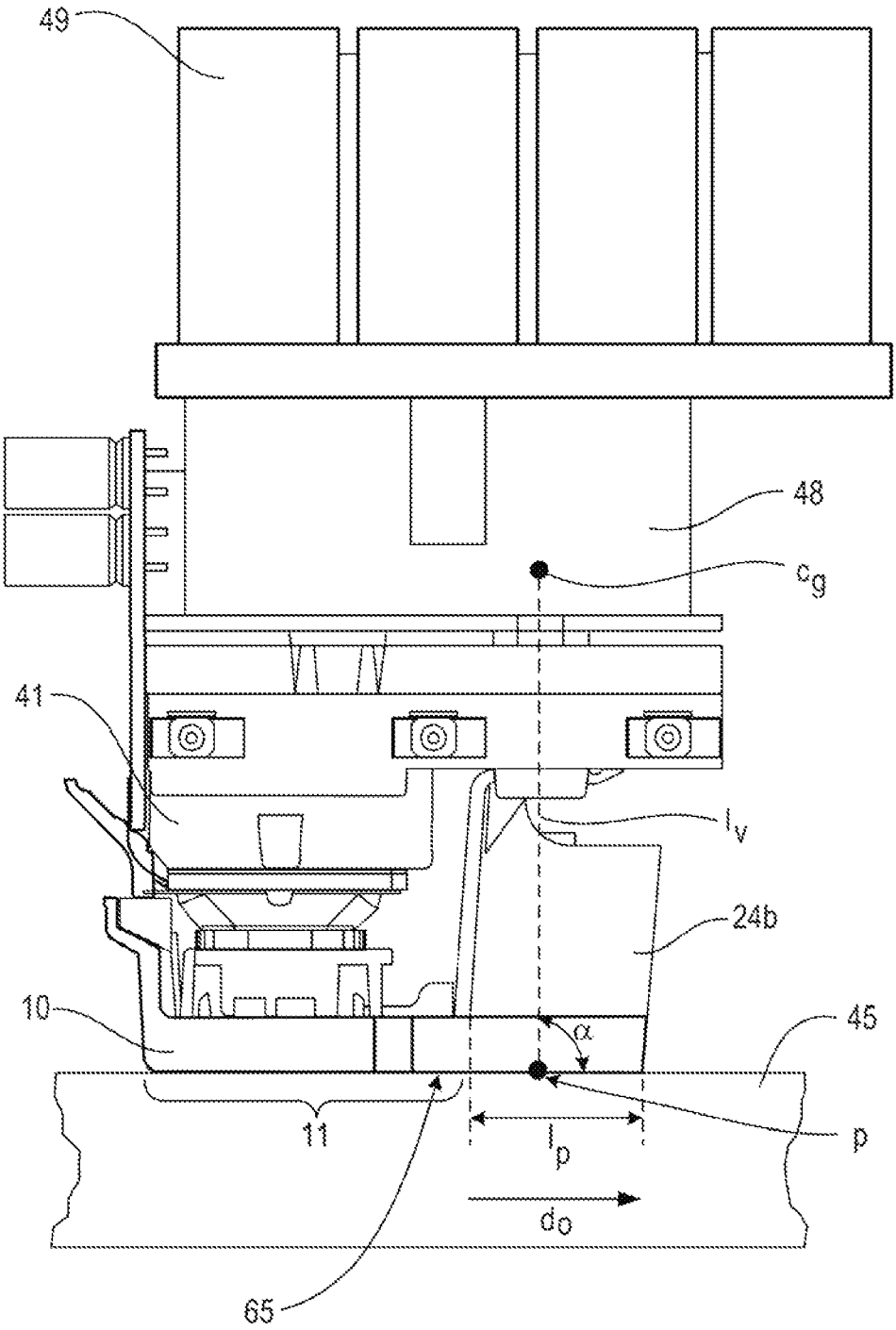
FIG. 6B is a cross-sectional view illustrating the cap assembly of FIG. 4A in a cap state with a print head device according to an example.

FIG. 6A is a bottom view illustrating an outer cap member of the cap assembly of FIG. 2 according to an example. FIG. 6B is a cross-sectional view illustrating the cap assembly of FIG. 4A in a cap state with a print head device according to an example. Referring to FIG. 6B, in some examples, the outer cap member 10 may include a main portion 11, a plurality of hinge portions 22 to engage with the print head device 31 (FIG. 4) to allow movement of the outer cap member 10 toward the print head device 31 to place the nozzles 31*a* (FIG. 4) in a cap state, a plurality of latch portions 23 to engage the print head device 31 in the cap state, a plurality of pedestal support portions 24*a*, 24*b*, and 24*c* extending outward from the main portion 11, and a support surface 65 to contact an external surface 45 to place the print head device 31 thereon.

For example, the support surface 65 may be substantially flat and have a sufficient length to place the print head device 31 on the external surface 45 in a stable manner to reduce an opportunity for the print head device 31 to fall over due to external forces. In some examples, the main portion 11 may include a width $w_m$, a plurality of main receiving portions 39*b* including detents to receive intermediate engagement portions 25, a plurality of access ports 39*a* in alignment with the main receiving portions 39*b* to allow a user access to disengage the engagement between the respective main receiving portions 39*b* and intermediate engagement portions 25, respectively, when desired, and a plurality of position portions 29 to contact and position the resilient members 27, respectively. As illustrated in FIG. 3, the position portion 29 may engage an end of a resilient member 27 and the intermediate engagement portion 28 may be proximate to another end of the resilient member 27.

Referring to FIGS. 6A-6B, in some examples, each one of the pedestal support portions 24*a*, 24*b*, and 24*c* may have a length $l_p$, for example, to accommodate a center of gravity $c_g$ of the print head device 31 in a cap state. For example, a length $l_p$ of the pedestal support members 24*a*. 24*b*, and 24*c* may enable the print head device 31 to be placed on an external surface 45 in a stable manner to reduce an opportunity for the print head device 31 to fall over due to external forces. In some examples, a length $I_p$ of a respective pedestal support member 24*b* may extend beyond a point p on a support surface 65 of the outer cap member 10 in an outward direction $d_0$. The point p on the support surface 65 may correspond to a vertical line $I_v$, extending from a center of gravity $c_g$ of a print head device 31 and forming an angle α of substantially ninety degrees with the support surface 65. A respective pedestal support portion 24*b* may be substantially equally spaced apart from other pedestal support portions 24*a* and 24*c* adjacent thereto. That is, the respective pedestal support portion 24*b* may be separated from the adjacent pedestal support portions 24*a* and 24*c* by the same distance $d_s$.

Referring to FIGS. 6A-6B, in some examples, the plurality of pedestal support portions 24*a*, 24*b*, and 24*c*, and the plurality of latch portions 23 may be disposed along a first side 61*a* of the main portion 11, and the plurality of hinge portions 22 may be disposed along a second side 61*b* of the main portion 11 opposite to the first side 61*a*. Additionally, each latch portion 23*a* and 23*b* or each hinge portion 22*a* and 22*b* may be disposed between adjacent pedestal support portions 24*a*, 24*b*, and 24*c*. For example, the pedestal support portions 24*a*, 24*b*, and 24*c* and the latch portions 23*a* and 23*b* (collectively 23) may be arranged in an alternate manner. That is, each latch portion 23*a* and 23*b* may be disposed between adjacent pedestal support portions 24*a*, 24*b*, and 24*c* along a same side of the main portion 11.

In some examples, the outer cap member 10 may include three pedestal support portions 24*a*, 24*b*, and 24*c* and two latch portions 23*a* and 23*b*. Alternatively, the pedestal support portions 24*a*. 24*b*, and 24*c* and the hinge portions 22*a* and 22*b* (collectively 22) may be arranged in an alternate manner. That is, each hinge portion 22*a* and 22*b* may be disposed between adjacent pedestal support portions 24*a*, 24*b*, and 24*c* along a same side of the main portion 11. In some examples, the outer cap member 10 may include two hinge portions 22*a* and 22*b*.

Figure 7:
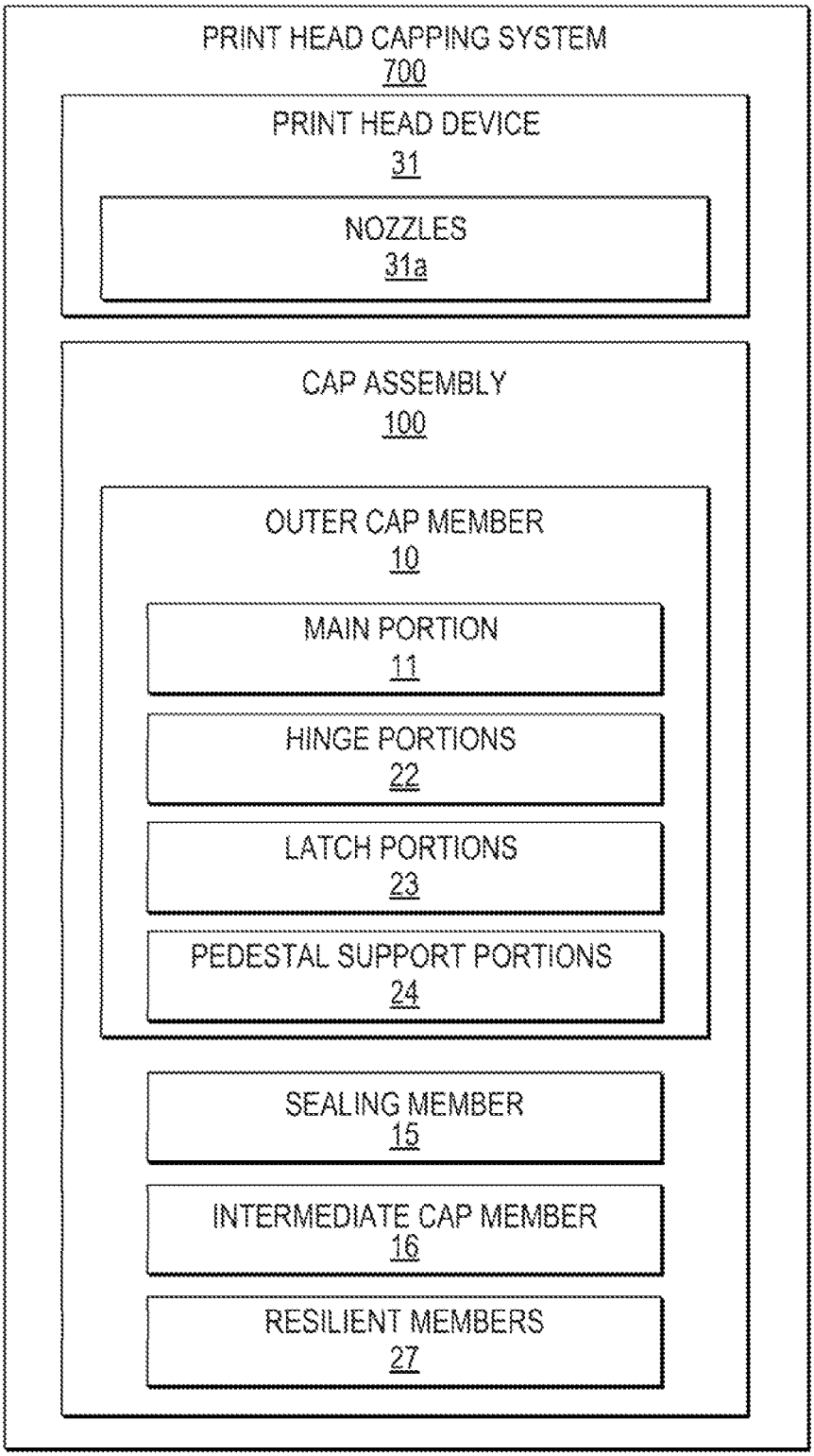
FIG. 7 is a block diagram illustrating a print head capping system according to an example.

FIG. 7 is a block diagram illustrating a print head capping system according to an example. Referring to FIG. 7, in some examples, a print head capping system 700 may include a print head device 31 having nozzles 31*a* to eject fluid there through. The print head capping system 700 may also include a cap assembly 100 to cap the nozzles 31*a* of the print head device 31 in a cap state, for example, as previously described with respect to FIGS. 1-6B. As previously described with respect to FIGS. 1-6B, in some examples, the cap assembly 100 may include an outer cap member 10, a sealing member 15, an intermediate cap member 16 disposed between the sealing member 15 and the outer cap member 10, and a plurality of resilient members 27 disposed between the sealing member 15 and the intermediate cap member 16.

Referring to FIG. 7, in some examples, the outer cap member 10 may include a main portion 11, a plurality of hinge portions 22, a plurality of latch portions 23, and a plurality of pedestal support portions 24. The plurality of hinge portions 22 may engage with the print head device 31 to allow movement of the outer cap member 10 toward the print head device 31 to place the nozzles 31*a* in a cap state. The plurality of latch portions 23 may engage the print head device 31 in the cap state. The plurality of pedestal support portions 24 may extend outward from the main portion 11. The sealing member 15 may seal the nozzles 31*a* of the print head device 31 in the cap state.

Referring to FIG. 7, the intermediate cap member 16 may support the sealing member 15. The plurality of resilient members 27 may provide a sealing force on the sealing member 15 to seal the nozzles 31*a* of the print head device 31 in the cap state. Additionally, the pedestal support portions 24 may be configured to contact an external surface 45 (FIG. 4) to support the print head device 31, for example, in a vertical position in the cap state. Further, when the print head device 31 is in the cap state and supported by the cap assembly 100, a force and/or vibration imparted on the print head device 31 may be transmitted to the outer cap member 10, rather than a direct force being applied to the sealing member 15. Thus, translations of the sealing member 15 resulting in adversely pumping air into and/or sucking ink out of the print head device 31 may be reduced.

The present disclosure has been described using non-limiting detailed descriptions of examples thereof that are not intended to limit the scope of the general inventive concept. It should be understood that features and/or operations described with respect to one example may be used with other examples and that not all examples have all of the features and/or operations illustrated in a particular figure or described with respect to one of the examples. Variations of examples described will occur to persons of the art. Furthermore, the terms "comprise," "include," "have" and their conjugates, shall mean, when used in the disclosure and/or claims, "including but not necessarily limited to."

It is noted that some of the above described examples may include structure, acts or details of structures and acts that may not be essential to the general inventive concept and which are described for illustrative purposes. Structure and acts described herein are replaceable by equivalents, which perform the same function, even if the structure or acts are different, as known in the art. Therefore, the scope of the general inventive concept is limited only by the elements and limitations as used in the claims.

What is claimed is:

1. A cap assembly usable with a print head device having nozzles to eject fluid there through, the cap assembly comprising:

an outer cap member including a main portion, at least one hinge portion to engage with the print head device to allow movement of the outer cap member toward the print head device to place the nozzles in a cap state, at least one latch portion to engage the print head device in the cap state, and at least one pedestal support portion extending outward from the main portion;

a sealing member to seal the nozzles of the print head device in the cap state;

an intermediate cap member disposed between the sealing member and the outer cap member, the intermediate cap member to support the sealing member; and at least one resilient member disposed between the sealing member and the intermediate cap member to provide a sealing force on the sealing member to seal the nozzles of the print head device in the cap state; and wherein the at least one pedestal support portion is configured to contact an external surface to support the print head device in the cap state.

2. The cap assembly according to claim 1, wherein the at least one pedestal support portions further comprises:

a plurality of at pedestal support portions extending outward from the main portion, a respective pedestal support portion of the plurality of pedestal support portions is substantially equally spaced apart from other pedestal support portions adjacent thereto.

3. The cap assembly according to claim 1, wherein each one of the intermediate cap member and the outer cap member is a single, unitary member.

4. The cap assembly according to claim 2, wherein the at least one latch portion further comprises a plurality of latch portions, each latch portion is disposed between adjacent pedestal support portions.

5. The cap assembly according to claim 1, wherein:

the outer cap member includes a plurality of position portions to contact and position the resilient members, respectively;

the intermediate cap member includes a set of intermediate engagement portions to engage the main portion of the outer cap member; and the sealing member includes a plurality of sealing engagement portions to engage the intermediate cap member.

6. The cap assembly according to claim 1, wherein a length of the at least one pedestal support portion extends beyond a point on a support surface of the outer cap member corresponding to a vertical line extending from a center of gravity of the print head device and forming an angle of substantially ninety degrees with the support surface.

7. A print head capping system, comprising a print head device having nozzles to eject fluid there through; and a cap assembly to cap the nozzles of the print head device in a cap state, including:

an outer cap member including a main portion, a plurality of hinge portions, a plurality of latch portions, and a plurality of pedestal support portions;

the plurality of hinge portions to engage with the print head device to allow movement of the outer cap member toward the print head device to place the nozzles in a cap state;

the plurality of latch portions to engage the print head device in the cap state;

the plurality of pedestal support portions extending outward from the main portion, the pedestal support portions configured to contact an external surface to support the print head device thereon in the cap state;

a sealing member to seal the nozzles of the print head device in the cap state;

an intermediate cap member disposed between the sealing member and the outer cap member, the intermediate cap member to support the sealing member; and a plurality of resilient members disposed between the sealing member and the intermediate cap member, the resilient members to provide a sealing force on the sealing member to seal the nozzles of the print head device in the cap state.

8. The print head capping system according to claim 7, wherein:

the outer cap member includes a plurality of position portions configured to contact and position the resilient members, respectively;

the intermediate cap member includes a plurality of intermediate engagement portions configured to engage the main portion of the outer cap member; and the sealing member includes a plurality of sealing engagement portions to engage the intermediate cap member.

9. The print head capping system according to claim 7, wherein the intermediate cap member is a single, unitary member.

10. The print head capping system according to claim 7, wherein a length of the pedestal support portions extends beyond a point on a support surface of the outer cap member corresponding to a vertical line extending from a center of gravity of the print head device and forming an angle of substantially ninety degrees with the support surface.

11. The print head capping system according to claim 7, wherein each latching portion of the plurality of latch portions or each hinge portion of the plurality of hinge portions is disposed between adjacent pedestal support portions of the plurality of pedestal support portions.

12. The print head capping system according to claim 11, wherein each latch portion of the plurality of latch portions are disposed between adjacent pedestal support portions of the plurality of pedestal support portions.

13. The print head capping system according to claim 7, wherein the plurality of latch portions and the plurality of pedestal support portions are disposed along a first side of the main portion and the plurality of hinge portions are disposed on a second side of the main portion opposite to the first side.

14. The print head capping system according to claim 7, wherein one pedestal support portion is substantially equally spaced apart from other pedestal support portions adjacent thereto.

15. The print head capping system according to claim 7, wherein the outer cap member is a single, unitary member.

* * * * *